US009624736B1

(12) United States Patent
Levrino et al.

(10) Patent No.: US 9,624,736 B1
(45) Date of Patent: Apr. 18, 2017

(54) SUCKER ROD END

(71) Applicant: Tenaris Connections BV, Amsterdam (NL)

(72) Inventors: Alejandro Levrino, Buenos Aires (AR); Matías Gustavo Pereyra, San Luis (AR); Jesus Aaron Abarca Alejandre, Veracruz (MX)

(73) Assignee: Tenaris Connections B.V. (NL)

( * ) Notice: Subject to any disclaimer, the term of this patent is extended or adjusted under 35 U.S.C. 154(b) by 0 days.

(21) Appl. No.: 15/061,353

(22) Filed: Mar. 4, 2016

(51) Int. Cl.
*E21B 17/04* (2006.01)
*E21B 17/042* (2006.01)
*E21B 19/16* (2006.01)

(52) U.S. Cl.
CPC ..... *E21B 17/0426* (2013.01); *E21B 19/161* (2013.01)

(58) Field of Classification Search
CPC ..... E21B 17/00; E21B 17/02; E21B 17/04; E21B 17/042; E21B 17/0426; E21B 17/1071; E21B 17/20; F04B 47/02; F04B 47/026; F04B 53/14; F04B 53/144; F16B 11/008; Y10T 403/47; Y10T 403/471; Y10T 403/472; Y10T 403/473
See application file for complete search history.

(56) References Cited

U.S. PATENT DOCUMENTS

| | | | | |
|---|---|---|---|---|
| 1,849,067 | A | 3/1932 | Bridges | |
| 2,751,194 | A | 6/1956 | Rohrback et al. | |
| 3,489,620 | A * | 1/1970 | Current | C21D 7/04 148/320 |

(Continued)

FOREIGN PATENT DOCUMENTS

| | | |
|---|---|---|
| CN | 2546615 | 4/2003 |
| CN | 2809189 | 8/2006 |
| CN | 201963212 | 9/2011 |

OTHER PUBLICATIONS

"API Specification 11B 27th Edition", American Petroleum Institute, Purchasing Guidelines Handbook, Nov. 2010, 13 pages.

*Primary Examiner* — Daniel Wiley
(74) *Attorney, Agent, or Firm* — Fish & Richardson P.C.

(57) ABSTRACT

A sucker rod including a sucker rod body (122); a transition section (125) having an outer surface disposed circumferentially around the longitudinal axis of the transition section, the outer surface having a longitudinal profile comprising a continuous curve beginning at the cylindrical outer surface of the rod body and having a concave curved portion having a radius ($R_A$) and a convex curved portion having a radius ($R_B$), wherein $R_B$ is less than $R_A$ and a diameter of the transition section measured transverse to the longitudinal axis (AA) is continuously increasing with distance from the outer surface of the rod; a wrench square section (127) having at least four wrench flats (124); a pin shoulder section (128) having a pin shoulder face (126) adapted to contact an end of a coupling (117) the pin shoulder face having an outer diameter ($D_F$); and a threaded pin connection section (129) having male threads.

18 Claims, 2 Drawing Sheets

(56) References Cited

U.S. PATENT DOCUMENTS

| | | | | | |
|---|---|---|---|---|---|
| 4,205,926 | A * | 6/1980 | Carlson | E21B 17/00 | 166/68 |
| 4,401,396 | A * | 8/1983 | McKay | E21B 17/00 | 403/13 |
| 4,430,018 | A * | 2/1984 | Fischer | E21B 17/00 | 403/268 |
| 4,430,787 | A * | 2/1984 | Paramore | E21B 17/0426 | 29/402.11 |
| 4,432,662 | A * | 2/1984 | Ronnkvist | E21B 17/00 | 228/113 |
| 4,433,933 | A * | 2/1984 | Parsons, Jr. | F16B 11/008 | 403/268 |
| 4,475,839 | A * | 10/1984 | Strandberg | E21B 17/04 | 403/2 |
| 4,484,833 | A * | 11/1984 | Gallagher, Jr. | E21B 17/00 | 403/266 |
| 4,585,368 | A * | 4/1986 | Pagan | E21B 17/00 | 166/68 |
| 4,653,953 | A * | 3/1987 | Anderson | E21B 17/00 | 403/265 |
| 4,822,201 | A * | 4/1989 | Iwasaki | E21B 17/04 | 403/268 |
| 4,919,560 | A * | 4/1990 | Rutledge, Jr. | E21B 17/04 | 403/13 |
| 6,193,431 | B1 * | 2/2001 | Rutledge | E21B 17/04 | 403/265 |
| 6,709,234 | B2 * | 3/2004 | Gilbert | F04D 7/065 | 403/305 |
| 7,316,268 | B2 * | 1/2008 | Peleanu | E21B 17/00 | 166/105 |
| 2012/0186818 | A1 * | 7/2012 | Wollmann | E21B 17/1071 | 166/301 |

* cited by examiner

SUCKER ROD END

FIELD OF INVENTION

This disclosure relates generally to the field of sucker rod strings used in oil wells and, more particularly, to an end design for a sucker rod.

BACKGROUND

The use of sucker rods within production tubing in an oil well is well known in the art. FIG. 1 is a schematic view illustrating a prior art pumping system. As shown in prior art FIG. 1, a pumping unit 1 is attached to a polish rod 2. The polish rod 2 is attached longitudinally to a sucker rod string 5 disposed inside of a tubing string 3 which is disposed in a casing string 4. The sucker rod string 5 is made up of multiple individual sucker rods according to American Petroleum Institute ("API") 11B specification (hereinafter "API 11B sucker rod string") coupled together in multiple connections 10 (only one shown). At the bottom end of the API 11B sucker rod string 5 is a reciprocating pump (not shown). As the pumping unit moves the sucker rod string 5 down, the barrel of the reciprocating pump fills with the production fluid 7 to be produced. Conversely, as the pumping unit moves the API 11B sucker rod string 5 up, a valve in the reciprocating pump shuts and the production fluid 7 in the pump barrel is lifted, displacing production fluid above it and forcing one pump-barrel's worth of production fluid 7 up the tubing string 3 in the annulus around the API 11B rod string 5 and the connections 10 on the way to the earth's surface and ultimately flowing out of the tubing string through valves and piping connections (not shown) and to storage and processing.

The API 11B sucker rod string 5 must extend from the pumping unit 1 all the way down to the reciprocating pump, which may be several thousand feet below the surface. As noted above, the API 11B sucker rod string 5 is made up of multiple individual API 11B sucker rods coupled together in multiple a connection 10. FIG. 1A illustrates an enlarged side cross section view of connection 10 of FIG. 1. The connection 10 includes a threaded pin end 29 on each of two adjacent API 11B sucker rods that are coupled together with a standard double female coupling 17. The coupling 17 is screwed onto the pins of the adjacent rods ("made up") until the ends of the coupling contact a face 26 of a pin shoulder 28 of the sucker rod.

FIG. 2 is a side view cross-section illustrating a prior art API 11B sucker rod 20 having API specification 11B end connections on both ends. The sucker rod 20 includes a rod body portion 22 having a diameter $D_{RAPI}$ and an upset bead portion 23 that transitions from the rod body 22 to a wrench flat portion 27. The wrench flat portion 27 typically includes four wrench flats 24. The wrench flat portion 27 terminates in a pin shoulder 28 having a pin shoulder face 26 that contacts the end of the coupling 17 (see FIG. 1A) when the threaded pin ends 29 are made up in the coupling 17 to form the connection 10. The outer circumferential surface of the rod 20 includes a transition section that transitions from the rod body 22 to the bead 23. The transition section includes a radius of curvature $R_{AAPI}$ extending from the rod body diameter $D_{RAPI}$ to upset bead 23. The radius of curvature $R_{AAPI}$ terminates in an inflection point in the surface of the upset bead 23 wherein the surface of the upset bead then transitions to the wrench flat section 27. The wrench flat 24 has a width $W_{SAPI}$ (transverse to an axis AA of the rod 20) and a length $L_{WSAPI}$ (along the axis AA of the rod 20). The connection 10 further includes a pin length $L_{PAPI}$ and a stress relief length $L_{SAPI}$. Table I below includes values for physical parameters expressed in millimeters ("mm") and dimensionless ratios of the API 11B rod connection 10 as illustrated in FIG. 2.

TABLE I

Sucker Rod End Data for Prior Art API 11B Rod as shown in FIG. 2

| Item | ¾ inch Nominal Rod Diameter | ⅞ inch Nominal Rod Diameter | 1 inch Nominal Rod Diameter |
|---|---|---|---|
| $D_{RAPI}$ (mm) | 19.05 | 22.2 | 25.4 |
| $R_{AAPI}$ (mm) | 57.1 | 66.7 | 76.2 |
| $L_{WSAPI}$ (mm) | 31.75 | 31.75 | 38.1 |
| $W_{SAPI}$ (Minimum) (mm) | 24.7 | 24.7 | 32.6 |
| $W_{SAPI}$ (Maximum) (mm) | 26.1 | 26.1 | 34.1 |
| Range of $W_{SAPI}/D_{RAPI}$ | 1.3-1.37 | 1.11-1.18 | 1.28-1.34 |
| $W_{SAPI}$ for FIG. 2 embodiment (mm) | 25.4 | 25.4 | 33.3 |
| $W_{SAPI}/D_{RAPI}$ for FIG. 2 embodiment (mm) | 1.33 | 1.14 | 1.31 |
| $R_{AAPI}/D_{DAPI}$ for FIG. 2 embodiment (mm) | 2.997 | 3.005 | 3 |

It has been observed that conventional API 11B sucker rods 20 have at least the following problems during use, e.g.:

Breakage in the zone of the upset bead 23 and wrench flat 24 due to fatigue failures (the upset bead is a zone frequently including a high number of surface defects) (due to the forging process that is used to produce that geometry) and the wrench square is subject to damage from torque wrenches when making up and breaking out the connection 20);

Many rods have to be reworked in the zone of the upset bead 23 due to kinking during forging; and High wear of the rod string 5 due to erosion and corrosion by movement of production fluid 7 in the annulus between the inner wall of the tubing 3 and the sucker rod connections 10, 20.

A new sucker rod end connection design is desirable to overcome these problems and other problems with API sucker rod end connections.

SUMMARY

Prior art sucker rod ends have been manufactured according to API standard 11B for many years. Even though the API design is suitable for sucker rods, some fatigue failures have taken place, particularly when they were subjected to high axial loads. The present disclosure describes a new design for a sucker rod end that includes improvements of rod end geometry which provides reduced stresses and better fatigue resistance particularly in the wrench square and forged zone of the new sucker rod. This new design provides reduced operation costs of wells using sucker rods. Additionally, the new rod design provides a more uniform geometry for induction heating during the manufacturing process.

The present disclosure describes and illustrates an improved sucker rod having a first end including: sucker rod body 122 having a generally cylindrical outer surface, a longitudinal axis and a rod diameter $D_R$; and a transition section 125 having a longitudinal axis. The transition section has a distal end disposed adjacent to a proximal end of the sucker rod body with the longitudinal axis of the transition section and the longitudinal axis of the rod body aligned. The transition section further includes an outer surface disposed circumferentially around the longitudinal axis of the transition section, wherein the outer surface includes a longitudinal profile with a continuous curve beginning at the cylindrical outer surface of the rod body and having a concave curved portion having a radius $R_A$ and a convex curved portion having a radius ($R_B$), wherein $R_B$ is less than $R_A$ and a diameter of the transition section 125 measured transverse to the longitudinal axis is continuously increasing with distance from the outer surface of the rod.

The sucker rod end further includes a wrench square section 127 having a distal end disposed adjacent to a proximal end of the transition section, wherein the wrench square section has a longitudinal axis aligned with the longitudinal axis of the rod body and the wrench square section includes at least four wrench flats 124 orthogonal to each other. Each wrench square section 127 has a cross sectional width $W_S$ measured transverse to an axis AA of the rod body and is the transverse distance across the rod body between two parallel wrench flats (see FIGS. 5 and 7). In some implementations, the adjacent wrench flats 124 may meet at a chamfered corner C.

The sucker rod end further includes a pin shoulder section 128 having a distal end disposed adjacent to a proximal end of the wrench square section. The pin shoulder section 128 has a longitudinal axis aligned with the longitudinal axis of the rod body, and a pin shoulder face 126 disposed on a proximal end of the pin shoulder section. The pin shoulder face is adapted to contact an end of a coupling and the pin shoulder face has an outer diameter $D_F$.

The sucker rod end further includes a threaded pin connection section 129 having a longitudinal axis aligned with the longitudinal axis of the rod body, said threaded pin connection section having a distal end disposed adjacent to a proximal end of the pin shoulder section 128, said threaded pin connection section including threads disposed on a portion of a circumferential exterior surface of the threaded pin connection section wherein the threads are configured to mate with threads inside the coupling.

In some implementations, the sucker rod may further include a second sucker rod end having a second transition section 125 having a longitudinal axis. The second transition section may include a distal end disposed adjacent to a proximal end of the sucker rod body with the longitudinal axis of the transition section and the longitudinal axis of the rod body aligned, wherein the transition section has an outer surface disposed circumferentially around the longitudinal axis of the transition section and the outer surface has a longitudinal profile comprising a continuous curve beginning at the cylindrical outer surface of the rod body and having a concave curved portion having a radius $R_A$ and a convex curved portion having a radius ($R_B$), wherein $R_B$ is less than $R_A$ and a diameter of the transition section 125 measured transverse to the longitudinal axis is continuously increasing with distance from the outer surface of the rod.

In some implementations, the second sucker rod end may further include a second wrench square section 127 having a distal end disposed adjacent to a proximal end of the transition section, wherein the wrench square section has a longitudinal axis aligned with the longitudinal axis of the rod body and the wrench square section includes at least four wrench flats 124 orthogonal to each other. Each wrench square section 127 has a cross sectional width $W_S$ measured transverse to an axis AA of the rod body and is the transverse distance across the rod body between two parallel wrench flats (see FIGS. 5 and 7). In some implementations, the adjacent wrench flats 124 may meet at a chamfered corner C. In some implementations, the adjacent wrench flats 124 may meet at a chamfered corner C.

In some implementations, the second sucker rod end may further include a second pin shoulder section 128 having a distal end disposed adjacent to a proximal end of the wrench square section. The pin shoulder section 128 has a longitudinal axis aligned with the longitudinal axis of the rod body, and a pin shoulder face 126 disposed on a proximal end of the pin shoulder section. The pin shoulder face is adapted to contact an end of a coupling, said pin shoulder face having an outer diameter $D_F$.

In some implementations the second sucker rod end may have a second threaded pin connection section 129 with a longitudinal axis aligned with the longitudinal axis of the rod body. The threaded pin connection section having a distal end disposed adjacent to a proximal end of the pin shoulder section 128, and the threaded pin connection section includes threads disposed on a portion of a circumferential exterior surface of the threaded pin connection section. The threads are configured to mate with threads inside a second coupling.

In some implementations, the pin shoulder section 128, of either or both of the first rod end and second rod end, includes a circumferential outer surface that transitions between the wrench square section 127 and the shoulder face. The pin shoulder section 128 has a diameter measured transverse to the longitudinal axis and is continuously increasing with distance from the wrench square section along the longitudinal axis of the pin shoulder section.

In some implementations either or both of the first rod end and second rod end includes a stress relief groove 121 disposed between the pin shoulder face 126 and the threads of threaded pin connection section 129.

In some implementations either or both of the first rod end and second rod end has a relationship $W_S/D_R$ is at least 1.5.

In some implementations either or both of the first rod end and second rod end includes a relationship $R_A/D_R$ is at least 3.3.

In some implementations a maximum transverse diameter of the coupling of either or both of the first rod end and second rod end is greater than a maximum transverse outer diameter of the rod body 122, the transition section 125, the threaded pin connection section 129 and the pin shoulder section 128.

In some implementations either or both of the first rod end and second rod end includes a chamfered corner having a substantially flat surface circumscribed in a Diameter $D_C$ less that the diameter $D_F$.

The present disclosure describes and illustrates an improved method of coupling sucker rods including the steps of:

providing a first sucker rod including:

a sucker rod body 122 having a generally cylindrical outer surface, a longitudinal axis and a rod diameter $D_R$;

a transition section 125 having a longitudinal axis, said transition section having a distal end disposed adjacent to a proximal end of the sucker rod body with the longitudinal axis of the transition section and the longitudinal axis of the rod body aligned, said transition section including an outer surface disposed circumferentially around the longitudinal axis of the transition section, said outer surface having a longitudinal profile comprising a continuous curve beginning at the cylindrical outer surface of the rod body and having a concave curved portion having a radius $R_A$ and a convex curved portion having a radius ($R_B$), wherein $R_B$ is less than $R_A$ and a diameter of the transition section 125 measured transverse to the longitudinal axis is continuously increasing with distance from the outer surface of the rod;

a wrench square section 127 having a distal end disposed adjacent to a proximal end of the transition section, said wrench square section having a longitudinal axis aligned with the longitudinal axis of the rod body, said wrench square section comprising at least four wrench flats 124, each said wrench flat 124 has a width $W_S$ measured transverse to an axis AA of the rod body;

a pin shoulder section 128 having a distal end disposed adjacent to a proximal end of the wrench square section, said pin shoulder section 128 having a longitudinal axis aligned with the longitudinal axis of the rod body, and having a pin shoulder face 126 disposed on a proximal end of the pin shoulder section, said pin shoulder face having an outer diameter $D_F$, wherein the pin shoulder section 128 includes a circumferential outer surface that transitions between the wrench square section 127 and the shoulder face and wherein the pin shoulder section 128 has a diameter measured transverse to the longitudinal axis that is continuously increasing with distance from the wrench square section along the longitudinal axis of the pin shoulder section, wherein the relationship $R_A/D_R$ is at least 3.3;

a threaded pin connection section 129 having a longitudinal axis aligned with the longitudinal axis of the rod body, said threaded pin connection section having a distal end disposed adjacent to a proximal end of the pin shoulder section 128, said threaded pin connection section including male threads disposed on a portion of a circumferential exterior surface of the threaded pin connection section; and providing a second sucker rod including:

a sucker rod body 122 having a generally cylindrical outer surface, a longitudinal axis and a rod diameter $D_R$;

a transition section 125 having a longitudinal axis, said transition section having a distal end disposed adjacent to a proximal end of the sucker rod body with the longitudinal axis of the transition section and the longitudinal axis of the rod body aligned, said transition section including an outer surface disposed circumferentially around the longitudinal axis of the transition section, said outer surface having a longitudinal profile comprising a continuous curve beginning at the cylindrical outer surface of the rod body and having a concave curved portion having a radius $R_A$ and a convex curved portion having a radius ($R_B$), wherein $R_B$ is less than $R_A$ and a diameter of the transition section 125 measured transverse to the longitudinal axis is continuously increasing with distance from the outer surface of the rod;

a wrench square section 127 having a distal end disposed adjacent to a proximal end of the transition section, said wrench square section having a longitudinal axis aligned with the longitudinal axis of the rod body, said wrench square section comprising at least four wrench flats 124, each said wrench flat 124 has a width $W_S$ measured transverse to an axis AA of the rod body;

a pin shoulder section 128 having a distal end disposed adjacent to a proximal end of the wrench square section, said pin shoulder section 128 having a longitudinal axis aligned with the longitudinal axis of the rod body, and having a pin shoulder face 126 disposed on a proximal end of the pin shoulder section, said pin shoulder face having an outer diameter $D_F$, wherein the pin shoulder section 128 includes a circumferential outer surface that transitions between the wrench square section 127 and the shoulder face and wherein the pin shoulder section 128 has a diameter measured transverse to the longitudinal axis that is continuously increasing with distance from the wrench square section along the longitudinal axis of the pin shoulder section, wherein the relationship $R_A/D_R$ is at least 3.3;

a threaded pin connection section 129 having a longitudinal axis aligned with the longitudinal axis of the rod body, said threaded pin connection section having a distal end disposed adjacent to a proximal end of the pin shoulder section 128, said threaded pin connection section including threads disposed on a proximal portion of a circumferential exterior surface of the threaded pin connection section; wherein the pin shoulder section 128 includes a circumferential outer surface that transitions between the wrench square section 127 and the shoulder face; and providing a coupling having proximal portion having female threads therein and a proximal face and a distal portion having female threads therein and a distal face;

inserting a proximal end of the threaded pin connection of the first rod into the proximal portion of a coupling; and rotating the sucker rod or the coupling until the pin shoulder face of the first rod contacts the proximal face of the coupling; and inserting a proximal end of the threaded pin connection of the second rod into the distal portion of a coupling; and rotating the second sucker rod or the coupling until the pin shoulder face of the second rod contacts the proximal face of the coupling.

In some implementations, the method of coupling sucker rods includes the first rod wherein adjacent wrench flats 124 of first sucker rod that are orthogonal to each other and meet at a chamfered corner comprising a flat surface. Each wrench flat 124 has a width $W_S$ measured transverse to an axis AA of the rod body and is the transverse distance across the rod body between the two parallel wrench flats (see FIGS. 5 and 7) In some implementations, the adjacent wrench flats 124 may meet at a chamfered corner C. The method includes a second rod wherein adjacent wrench flats 124 of second sucker rod are orthogonal to each other and meet at a chamfered corner comprising a flat surface. Each wrench flat 124 has a width $W_S$ measured transverse to an axis AA of the rod body and is the transverse distance across the rod body between two parallel wrench flats (see FIGS. 5 and 6). In some implementations, the adjacent wrench flats 124 may meet at a chamfered corner C.

BRIEF DESCRIPTION OF DRAWINGS

Like reference symbols in the various drawings indicate like elements.

DETAILED DESCRIPTION OF DRAWINGS

Figure 3:
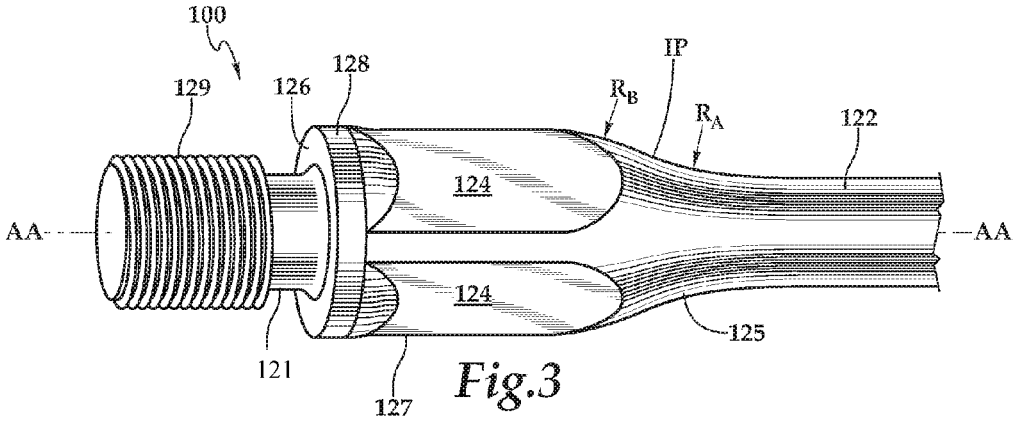
FIG. 3 is a perspective view of a new sucker rod end of the present disclosure.
Figure 4:
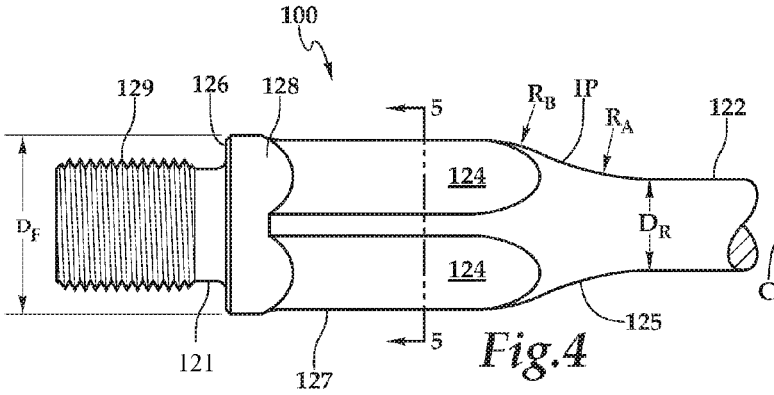
FIG. 4 is a top cross-section view of the sucker rod end of FIG. 3.

FIG. 3 is a perspective view of a sucker rod end of the present disclosure and FIG. 4 is a top cross-section view of the sucker rod end of FIG. 3. The sucker rod 100 includes a rod body portion 122 having a diameter $D_R$ and transition section 125 that transitions from the rod body 122 to a wrench square section 127 having a plurality of wrench flats 124.

The transition section 125 includes a circumferential outer surface that has a first concave curved portion (viewed from the outside) having a radius $R_A$ and a second convex curved portion having a radius $R_B$. The radius $R_A$ and the radius $R_B$ meet at an inflection point (IP) where the curved surfaces A and B are tangent to each other. $R_B$ is less than $R_A$ and a diameter of the transition section 125 measured transverse to the longitudinal axis is continuously increasing with distance from the rod body along the longitudinal axis of the transition section. The transition section 125 terminates at a wrench square section 127.

Figure 1:
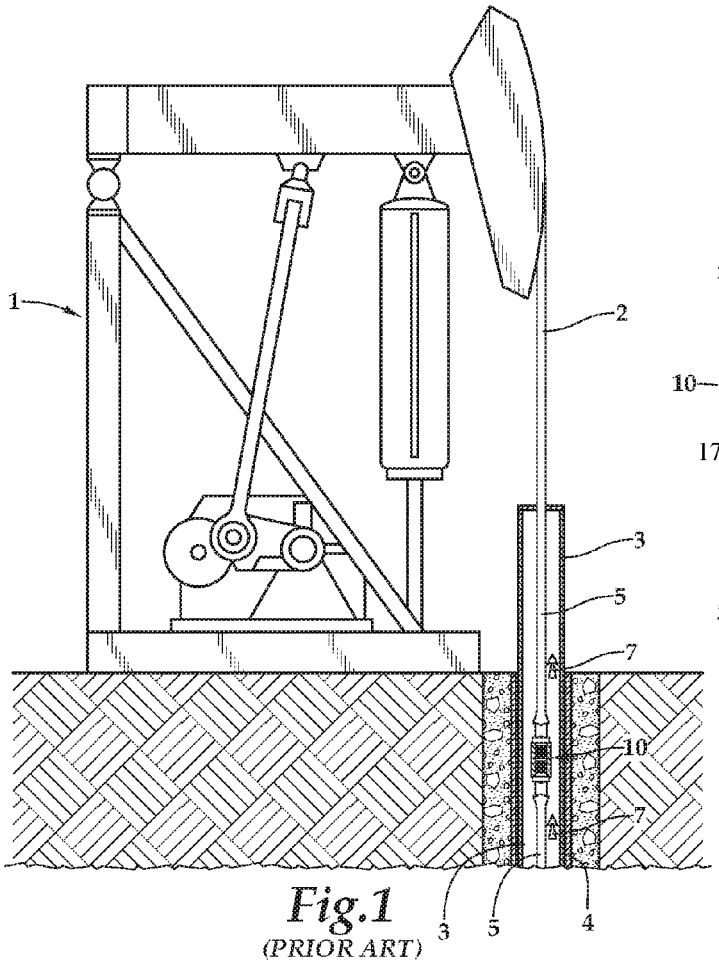
Fig.1 (PRIOR ART)
FIG. 1 is a schematic of a prior art pumping system illustrating a prior art API 11B specification sucker rod string disposed inside a tubing string in a wellbore.
Figure 1A:
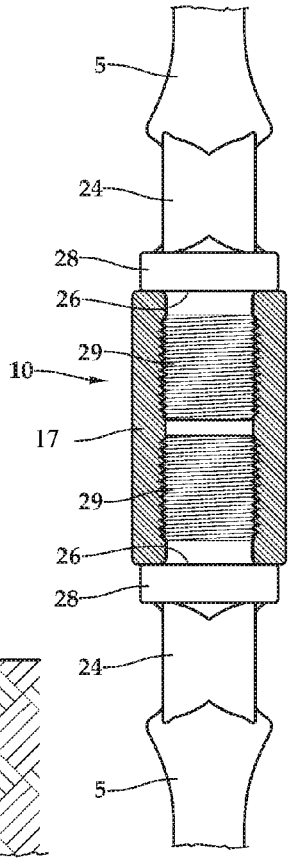
Fig.1A (PRIOR ART)
FIG. 1A is an enlarged side cross-section of a prior art sucker rod end of the prior art API11B sucker rod of FIG. 1.
Figure 5:
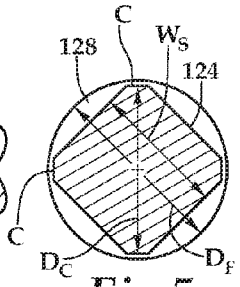
FIG. 5 is an end cross-section view of the sucker rod end of FIG. 4.
Figure 7:
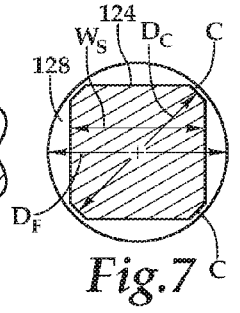
FIG. 7 is an end cross-section view of the sucker rod end of FIG. 6.

The wrench square section 127 includes a distal end disposed adjacent to a proximal end of the transition section, wherein the wrench square section has a longitudinal axis aligned with the longitudinal axis of the rod body and the wrench square section includes at least four wrench flats 124 orthogonal to each other. The wrench square section 127 terminates in a pin shoulder section 128 having a pin shoulder face 126 that contacts the end of a standard coupling (for an example of a standard coupling see item 27 in FIG. 1A) when the threaded pin ends 129 are made up with the coupling to form a connection. Each wrench square section 127 has a cross sectional width $W_S$ measured transverse to an axis AA of the rod body and is the transverse distance across the rod body between two parallel wrench flats (see FIGS. 5 and 7). In some implementations, the adjacent wrench flats 124 may meet at a chamfered corner C. Length $L_{WS}$ is the length of the wrench flat (measured along the axis AA of the rod body 122).

Figure 6:
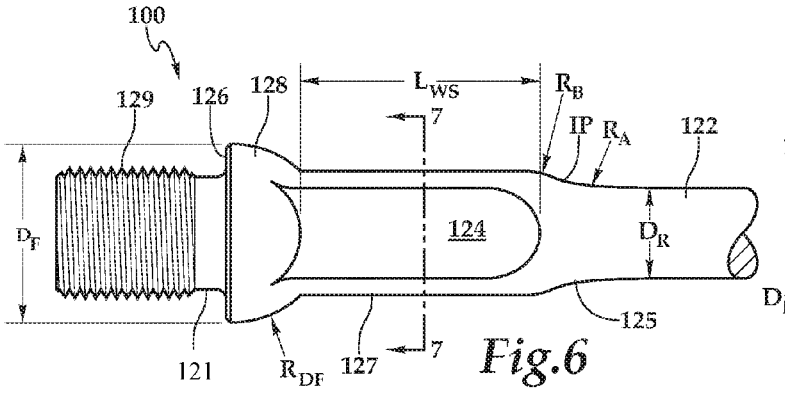
FIG. 6 is a side cross-section view of the sucker rod end of FIG. 3 rotated 45 degrees from the top view illustrated in FIG. 4.

The pin shoulder section 128 includes a circumferential outer surface that includes a convex surface (viewed from the outside) having a radius $R_{DF}$. The pin shoulder section further includes a pin shoulder face 126 with a Diameter $D_F$ (See FIGS. 5 and 6).

A threaded pin connection section 129 having a longitudinal axis aligned with the longitudinal axis of the rod body is connected to the pin shoulder section. The threaded pin connection includes male threads adapted to mate with female threads inside the coupling. A stress relief groove 121 is disposed between the shoulder face 126 and the threads of thread pin connection 129.

Table I below includes values for physical parameters expressed in millimeters ("mm") and dimensionless ratios of an exemplary embodiment of the present invention as illustrated in FIGS. 3-7.

TABLE II

Sucker Rod End Data of the Exemplary Embodiment of FIGS. 3-7

| Item | ¾ inch Nominal Rod Diameter | ⅞ inch Nominal Rod Diameter | 1 inch Nominal Rod Diameter |
|---|---|---|---|
| $D_R$ (mm) | 19.05 | 22.2 | 25.4 |
| $R_A$ (mm) | 67 | 76.2 | 85.2 |
| $R_B$ (mm) | 30 | 30 | 40 |
| $D_C$ ( ) (mm) | 36 | 40 | 49 |
| $D_F$ (mm) | 38 | 41.3 | 50.8 |
| $R_{DF}$ (mm) | 25.4 | 25.4 | 27.2 |
| $L_{WS}$ (mm) | 38.0 | 45.0 | 48.0 |
| $W_S$ (Minimum) (mm) | 27.8 | 32.60 | 37.4 |
| $W_S$ (Maximum) (mm) | 29.4 | 34.10 | 38.8 |

TABLE II-continued

Sucker Rod End Data of the Exemplary Embodiment of FIGS. 3-7

| Item | ¾ inch Nominal Rod Diameter | ⅞ inch Nominal Rod Diameter | 1 inch Nominal Rod Diameter |
|---|---|---|---|
| Range of $W_S/D_R$ | 1.46-1.54 | 1.47-1.54 | 1.47-1.53 |
| $W_S/D_R$ | 1.50 | 1.51 | 1.50 |
| $R_A/D_R$ | 3.517 | 3.432 | 3.374 |

Figure 2:
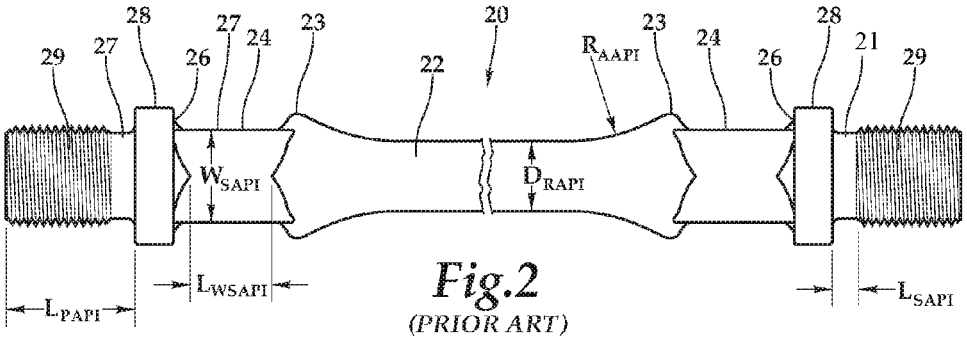
Fig.2 (PRIOR ART)
FIG. 2 is a side cross-section view of the API 11B sucker rod of FIG. 1.

The design of the present disclosure reduces stresses in the wrench flat section and the forged zone and reduces fatigue failures. The new design of the present disclosure illustrated in FIGS. 3-7 and as described herein includes at least the following improvements/advantages over the API 11B sucker rod of FIGS. 1-2.

The upset bead 23 in the API 11B connection positioned between the wrench flat 24 and the sucker rod body 22 is eliminated in the new design and instead of the upset bead 23, the rod body 122 of the new design is joined smoothly with the wrench square section 127 by a smooth continuous transition section 125 including a continuous circumferential outer surface that includes a first concave (viewed from the outside) curved portion having a radius $R_A$ and a second convex curved portion having a radius $R_B$ that meet at an inflection point IP. $R_B$ is less than $R_A$ and a diameter of the transition section 125 measured transverse to the longitudinal axis is continuously increasing with distance from the rod body along the longitudinal axis of the transition section.

Due to the absence of the upset bead 23 in the new design, it is possible to enlarge the dimension of the wrench square $W_S$ and the dimension of the radius $R_A$ in the new end design for a specific rod diameter, but keeping these values inside the API 11B standardized values in order to use standard equipment for handling the rods and torqueing the rod connections (e.g. elevators and rod wrenches and tongs). With the new rod end geometry, for example, you can use the value of "$W_{SAPI}$" of a 1" diameter API rod in a new design rod of ⅞" diameter. This results in maximizing the dimension of the width $W_S$ of wrench square portion 127 of the new end sucker rod in comparison to the wrench flat 24 of a standardized by API 11B for the same rod diameter, but the dimensions of the wrench square still remain within the API standardized values.

The ratio relationship ($W_S/D_R$) of wrench square width $W_S$ to rod diameter RD is increased in the design of the present disclosure over the relationship of $W_{SAPI}/D_{RAPI}$ of the width of the wrench square $W_{SAPI}$ of the API 11B rod end and the rod diameter of the API rod $D_{RAPI}$. (See values and ratios in Tables I and II wherein the new design has a relationship $W_S/D_R$ of at least 1.5 while API designs have a relationship $W_{SAPI}/D_{RAPI}$ between 1.14-1.3). Increasing the size of the wrench square section of the sucker rod end in relation to particular rod sizes (e.g. increasing the value $W_S/D_R$) is advantageous because the wrench square is a part of the rod that can be easily damaged during handling (e.g. making up and breaking out of a connection). Damage to the wrench square section 127 can lead to stress concentrators and cracks that can generate fatigue failures during use.

Removing the upset bead used in the prior art API 11B design has the additional benefit of reducing wear of the interior surface of the tubing 3 by the moving rod string 5. This is accomplished using the new design by spreading out (distributing) the contact (abrasion) points between sucker rod and tubing. In API Rod end 11B designs the upset bead is a part of the rod having the largest diameter and is usually in contact with the tubing in a very small area, generating high contact pressures and damage in the softer of the contacting elements (i.e., the tubing) resulting in premature failure of the tubing via a worn hole.

Additionally, removing the upset bead eliminates an area where forging defects appear in standard prior art API rods that require a rework of the upset bead (23) after forging of the end for an API 11B rod due to cracks, forging fins and scale. The upset bead 23 of an API 11 B rod is subject to high deflection during forging which may result in high remaining stresses after forging that can produce cracks which are stress concentrators that may lead to fatigue failure, therefore it is desirable to eliminate the bead thereby avoiding these type of defects in the sucker rod surface.

Enlarging the radius of the continuous curved smooth transition section 125 of the rod of this disclosure with respect to transition section of the standardized API 11B rod for a specific rod diameter increases the corrosion fatigue resistance. This increased radius is illustrated using the ratio $R_A/D_R$ of the radius $R_A$ of a curved portion of the transition section 125 and the rod diameter $D_R$ of the new sucker rod end to the ratio $R_{API}/D_{RAPI}$ for the API rod (See values and ratios in Tables I and II wherein the new design has a relation $R_A/D_R>3$ while API 11B designs had a relation $R_{API}/D_{RAPI}$ approximately equal to 3). This increased ($R_A/D_R$) ratio provides a smoother transition for the fluid flow across the sucker rod end, reduces turbulence areas (high friction areas). In the API rod the smaller ($R_{API}/D_{RAPI}$) ratio combined with the fluid corrosiveness and turbulent flow contribute to pitting initiation and lead to cracking that may result in a corrosion fatigue failure in the forged end transition section of the API rod.

Replacing the abrupt change of diameter between wrench square portions 27 and the shoulder 26 in the API rod design (See FIG. 2) with a continuous curved exterior surface of the pin shoulder section 128 having a radius $R_{DF}$ in the new design (see FIG. 6) provides a smoother transition for the fluid flow and reduces the turbulence and pressure drop across the sucker rod end.

Since there is no upset bead in the new sucker rod end design (as is present in the API 11 B sucker rod end), the new sucker rod end geometry has lower values of pressure losses in the production fluid 7 flowing along the outer surface of the sucker rod end for the same rod diameter and tubing diameter as an API 11 B rod. (See Table III and Table IV attached) This improved production fluid 7 flow increases the productivity of a well in which rods of the new design are installed and reduces erosion-corrosion of the rods in the well and thereby increases the lifetime of rods with the new sucker rod end design.

Additionally, since there is no upset bead in the new design, the contact surfaces between the connection and the tubing will be the maximum transverse outer diameter (e.g., a diameter measured perpendicular to a longitudinal axis) of the coupling 27 and the corners of the wrench square depending on the well deviation. Compared to the API 11B design where the upset bead creates high wearing pressure (because of the reduced contact area) thus increasing the tubing and sucker rod wearing rate. This new sucker rod end geometry will concentrate the wearing on couplings and in a lower degree (compared to the API 11B design) on the corners of the sucker rod wrench square. Therefore, the coupling is the most likely element to wear due to friction associated with contact of the coupling and tubing wall. This results in less wear on the other sucker rod end elements. Which ultimately results in lower maintenance costs for a well having sucker rods with the new design sucker rod end because the coupling is the least expensive item and the easiest item in the rod string to replace.

Experimental Data

In Table III and Table IV below well fluid A and B represents two different types of typical fluid types for wells using sucker rods.

TABLE III

Characteristics of Well Fluid A and B

| | Fluid A | Fluid B |
|---|---|---|
| Grade API | 23 | 45 |
| Density (gr/cm3) | 0.97 | 0.799 |
| Paraffin content | 3% | 24% |
| Pour Point | 16° C. | (−3° C.) |

A fluid flow simulation has been performed in order to assess the flow characteristics (reverse flow, flow turbulence, pressure drop, force on the sucker rod due to fluid flow, force on the tube due to the fluid flow, Friction and Pression on the joint) comparing Tenaris design with API design.

Table IV: Flow Simulation Results Expressed in Absolute Values

In this Table IV, Tenaris-A are simulation results for a rod end of the present disclosure used in fluid A of Table III and API-A is the API rod simulation results in Fluid A of Table III. Tenaris-B and API-B are simulation results for Fluid B of Table III.

| Case | | | 1-Tenaris A | 2-API A | 3-Tenaris B | 4-API B |
|---|---|---|---|---|---|---|
| Reverse Flow Volume | | [cm3] | 1.14 | 2.92 | 1.17 | 2.94 |
| Flow turbulence | Upstream | [j]x1e3 | 0.98 | 0.98 | 0.81 | 0.82 |
| | In the joint | [j]x1e3 | 1.23 | 1.89 | 1.02 | 1.56 |
| | Downstream | [j]x1e3 | 1.52 | 1.62 | 1.26 | 1.34 |
| Pressure drop | Upstream | [Pa] | 141 | 141 | 119 | 119 |
| | In the joint | [Pa] | 425 | 531 | 354 | 442 |
| | Downstream | [Pa] | 124 | 127 | 104 | 107 |
| Force on the sucker Rod due to the fluid flow | Upstream | [N] | 0.0222 | 0.0223 | 0.0186 | 0.0187 |
| | In the joint | [N] | 0.191 | 0.2482 | 0.1592 | 0.2062 |
| | Downstream | [N] | 0.0231 | 0.0234 | 0.0195 | 0.0196 |
| Force on the tube due to the fluid flow | Upstream | [N] | 0.0528 | 0.053 | 0.0443 | 0.0444 |
| | In the joint | [N] | 0.0535 | 0.0587 | 0.0448 | 0.0492 |
| | Downstream | [N] | 0.054 | 0.0551 | 0.0452 | 0.0462 |
| Friction on the joint | In the joint | [N] | 0.0277 | 0.0267 | 0.0234 | 0.0224 |
| Pression on the joint | In the joint | [N] | 0.1632 | 0.2215 | 0.1358 | 0.1838 |

In Table V below the results are non-dimensional, meaning that they are split to the same value obtained in a simulation of 1 m of rod body (with no connection).

TABLE V Flow Simulation Results for One Meter of Rod Body (with No Connection) Expressed in Non-Dimensional Values In this Table V, Tenaris-A are simulation results for a rod of the present disclosure used in fluid A of Table III and API-A is the API rod simulation results in Fluid A of Table III. Tenaris-B and API-B are simulation results for Fluid B of Table III.

| Case | | 1-Tenaris A | 2-API A | 3-Tenaris B | 4-API B | Reduction |
|---|---|---|---|---|---|---|
| Reverse Flow Volume | | 0.39 | 1 | 0.4 | 1.01 | 60% |
| Flow turbulence | Upstream | 1 | 1 | 0.83 | 0.83 | 0% |
| | In the joint | 1.25 | 1.93 | 1.04 | 1.59 | 35% |
| | Downstream | 1.55 | 1.65 | 1.28 | 1.37 | 6% |
| Pressure drop | Upstream | 1 | 1 | 0.84 | 0.84 | 0% |
| | In the joint | 3 | 3.76 | 2.5 | 3.12 | 20% |
| | Downstream | 0.88 | 0.9 | 0.74 | 0.75 | 2% |
| Force on the sucker Rod due to the fluid flow | Upstream | 1 | 1 | 0.84 | 0.84 | 0% |
| | In the joint | 8.57 | 11.14 | 7.15 | 9.25 | 23% |
| | Downstream | 1.04 | 1.05 | 0.87 | 0.88 | 1% |
| Force on the tube due to the fluid flow | Upstream | 2.37 | 2.38 | 1.99 | 1.99 | 0% |
| | In the joint | 2.4 | 2.63 | 2.01 | 2.21 | 9% |
| | Downstream | 2.42 | 2.47 | 2.03 | 2.07 | 2% |
| Friction on the joint | In the joint | 1.25 | 1.2 | 1.05 | 1.01 | −4% |
| Pression on the joint | In the joint | 7.33 | 9.94 | 6.09 | 8.25 | 26% |

A preferred embodiment has been disclosed and described herein. Other implementations are within the scope of the following claims.

The invention claimed is:

1. An integral metal sucker rod having a first end, said first end comprising:

a sucker rod body having a generally cylindrical outer surface, a longitudinal axis and a rod diameter ($D_R$);

a transition section having a longitudinal axis, said transition section having a distal end disposed adjacent to a proximal end of the sucker rod body with the longitudinal axis of the transition section and the longitudinal axis of the sucker rod body aligned, said transition section including an outer surface disposed circumferentially around the longitudinal axis of the transition section, said outer surface having a longitudinal profile comprising a continuous curve beginning on the cylindrical outer surface of the sucker rod body and having a concave curved portion tangent to the cylindrical outer surface of the sucker rod, said transition section having a radius ($R_A$) and a convex curved portion having a radius ($R_B$), wherein $R_B$ is less than $R_A$ and a diameter of the transition section measured transverse to the longitudinal axis is continuously increasing with distance from the cylindrical outer surface of the sucker rod body;

a wrench square section having a distal end disposed adjacent to a proximal end of the transition section, said wrench square section having a longitudinal axis aligned with the longitudinal axis of the sucker rod body, said wrench square section comprising at least four wrench flats orthogonal to each other;

a pin shoulder section having a distal end disposed adjacent to a proximal end of the wrench square section, said pin shoulder section having a longitudinal axis aligned with the longitudinal axis of the rod body, and having a pin shoulder face disposed on a proximal end of the pin shoulder section, said pin shoulder face adapted to contact an end of a coupling, said pin shoulder face having an outer diameter ($D_F$) and a threaded pin connection section having a longitudinal axis aligned with the longitudinal axis of the rod body, said threaded pin connection section having a distal end disposed adjacent to a proximal end of the pin shoulder section, said threaded pin connection section including threads disposed on a portion of a circumferential exterior surface of the threaded pin connection section, said threads configured to mate with threads inside the coupling.

2. The sucker rod of claim 1, wherein adjacent wrench flats meet at a chamfered corner comprising a flat surface, each wrench square section has a cross sectional width ($W_S$) measured transverse to an axis (AA) of the sucker rod body and is a transverse distance across the sucker rod body between two parallel wrench flats.

3. The sucker rod of claim 2 having a second end, said second end further comprising a:

a second transition section having a longitudinal axis, said transition section having a distal end disposed adjacent to a proximal end of the sucker rod body with the longitudinal axis of the transition section and the longitudinal axis of the sucker rod body aligned, said transition section including an outer surface disposed circumferentially around the longitudinal axis of the transition section, said outer surface having a longitudinal profile comprising a continuous curve beginning at the cylindrical outer surface of the sucker rod body and having a concave curved portion having a radius ($R_A$) and a convex curved portion having a radius ($R_B$) wherein $R_B$ is less than $R_A$ and a diameter of the transition section measured transverse to the longitudinal axis is continuously increasing with distance from the cylindrical outer surface of the sucker rod body;

a second wrench square section having a distal end disposed adjacent to a proximal end of the transition section, said wrench square section having a longitudinal axis aligned with the longitudinal axis of the rod body, said wrench square section comprising at least four wrench flats orthogonal to each other;

a second pin shoulder section having a distal end disposed adjacent to a proximal end of the wrench square section, said pin shoulder section having a longitudinal axis aligned with the longitudinal axis of the rod body, and having a pin shoulder face disposed on a proximal end of the pin shoulder section, said pin shoulder face adapted to contact an end of a coupling, said pin shoulder face having an outer diameter ($D_F$) and a second threaded pin connection section having a longitudinal axis aligned with the longitudinal axis of the rod body, said threaded pin connection section having a distal end disposed adjacent to a proximal end of the pin shoulder section, said threaded pin connection section including threads disposed on a portion of a circumferential exterior surface of the threaded pin connection section, said threads configured to mate with threads inside a second coupling.

4. The sucker rod of claim 3, wherein adjacent wrench flats of the second end meet at a chamfered corner comprising a flat surface, each wrench square section has a cross sectional width ($W_S$) measured transverse to an axis (AA) of the sucker rod body and is a transverse distance across the sucker rod body between two parallel wrench flats.

5. The sucker rod of claim 4 wherein the chamfered corner of the second end comprises a substantially flat surface circumscribed in a diameter ($D_C$) less that the diameter ($D_F$).

6. The sucker rod of claim 3 wherein a relationship $W_S/D_R$ is at least 1.5.

7. The sucker rod of claim 3 wherein a relationship $R_A/D_R$ is at least 3.3.

8. The sucker rod of claim 3 wherein a maximum transverse diameter of a non-integral coupling disposed on the threaded pin connection section is greater than a maximum transverse outer diameter of the sucker rod body, the transition section, the threaded pin connection section and the pin shoulder section.

9. The sucker rod of claim 2 wherein a relationship $W_S/D_R$ is at least 1.5.

10. The sucker rod of claim 9 wherein the $W_S$ of a rod with a $D_R$ of ⅞ inch equals a $W_{SAPI}$ of an API 11 B standard rod with a $D_{RAPI}$ of 1 inch.

11. The sucker rod of claim 2 wherein a maximum transverse diameter of a non-integral coupling disposed on the threaded pin connection section is greater than a maximum transverse outer diameter of the sucker rod body, the transition section, the threaded pin connection section and the pin shoulder section.

12. The sucker rod of claim 2 wherein the chamfered corner comprises a substantially flat surface circumscribed in a diameter ($D_C$) less that the diameter ($D_F$).

13. The sucker rod of claim 1 wherein the pin shoulder section includes a circumferential convex outer surface that transitions between the wrench square section and the pin shoulder face and wherein the pin shoulder section has a diameter measured transverse to the longitudinal axis that is continuously increasing with distance from the wrench square section along the longitudinal axis of the pin shoulder section.

14. The sucker rod of claim 1 wherein a stress relief groove is disposed between the pin shoulder face and the threads of the threaded pin connection section.

15. The sucker rod of claim 1 wherein a relationship $R_A/D_R$ is at least 3.3.

16. The sucker rod of claim 1 wherein a maximum transverse diameter of a non-integral coupling disposed on the threaded pin connection section is greater than a maximum transverse outer diameter of the sucker rod body, the transition section, the threaded pin connection section and the pin shoulder section.

17. A method of coupling integral metal sucker rods comprising:

providing a first integral sucker rod including:

a sucker rod body having a generally cylindrical outer surface, a longitudinal axis and a rod diameter ($D_R$), a transition section having a longitudinal axis, said transition section having a distal end disposed adjacent to a proximal end of the sucker rod body with the longitudinal axis of the transition section and the longitudinal axis of the sucker rod body aligned, said transition section including an outer surface disposed circumferentially around the longitudinal axis of the transition section, said outer surface having a longitudinal profile comprising a continuous curve beginning on the cylindrical outer surface of the sucker rod body and having a concave curved portion tangent to the cylindrical outer surface of the sucker rod, said transition section having a radius ($R_A$) and a convex curved portion having a radius ($R_B$), wherein $R_B$ is less than $R_A$ and a diameter of the transition section measured transverse to the longitudinal axis is continuously increasing with distance from the cylindrical outer surface of the sucker rod body;

a wrench square section having a distal end disposed adjacent to a proximal end of the transition section, said wrench square section having a longitudinal axis aligned with the longitudinal axis of the rod body, said wrench square section comprising at least four wrench flats orthogonal to each other;

a pin shoulder section having a distal end disposed adjacent to a proximal end of the wrench square section, said pin shoulder section having a longitudinal axis aligned with the longitudinal axis of the rod body, and having a pin shoulder face disposed on a proximal end of the pin shoulder section, said pin shoulder face having an outer diameter $D_F$, wherein the pin shoulder section includes a circumferential outer surface that transitions between the wrench square section and the pin shoulder face and wherein the pin shoulder section has a diameter measured transverse to the longitudinal axis that is continuously increasing with distance from the wrench square section along the longitudinal axis of the pin shoulder section;

a threaded pin connection section having a longitudinal axis aligned with the longitudinal axis of the rod body, said threaded pin connection section having a distal end disposed adjacent to a proximal end of the pin shoulder section, said threaded pin connection section including male threads disposed on a portion of a circumferential exterior surface of the threaded pin connection section; and providing a second integral metal sucker rod including:

a sucker rod body having a generally cylindrical outer surface, a longitudinal axis and a rod diameter ($D_R$), a transition section having a longitudinal axis, said transition section having a distal end disposed adjacent to a proximal end of the sucker rod body with the longitudinal axis of the transition section and the longitudinal axis of the sucker rod body aligned, said transition section including an outer surface disposed circumferentially around the longitudinal axis of the transition section, said outer surface having a longitudinal profile comprising a continuous curve beginning on the cylindrical outer surface of the sucker rod body and having a concave curved portion tangent to the cylindrical outer surface of the sucker rod, said transition section having a radius ($R_A$) and a convex curved portion having a radius ($R_B$) wherein $R_B$ is less than $R_A$ and a diameter of the transition section measured transverse to the longitudinal axis is continuously increasing with distance from the cylindrical outer surface of the sucker rod body;

a wrench square section having a distal end disposed adjacent to a proximal end of the transition section, said wrench square section having a longitudinal axis aligned with the longitudinal axis of the rod body, said wrench square section comprising at least four wrench flats orthogonal to each other;

a pin shoulder section having a distal end disposed adjacent to a proximal end of the wrench square section, said pin shoulder section having a longitudinal axis aligned with the longitudinal axis of the rod body, and having a pin shoulder face disposed on a proximal end of the pin shoulder section, said pin shoulder face having an outer diameter $D_F$, wherein the pin shoulder section includes a circumferential outer surface that transitions between the wrench square section and the pin shoulder face and wherein the pin shoulder section has a diameter measured transverse to the longitudinal axis that is continuously increasing with distance from the wrench square section along the longitudinal axis of the pin shoulder section;

a threaded pin connection section having a longitudinal axis aligned with the longitudinal axis of the rod body, said threaded pin connection section having a distal end disposed adjacent to a proximal end of the pin shoulder section, said threaded pin connection section including threads disposed on a proximal portion of a circumferential exterior surface of the threaded pin connection section; wherein the pin shoulder section includes a circumferential outer surface that transitions between the wrench square section and the pin shoulder face; and providing a non-integral coupling having proximal portion having female threads therein and a proximal face and a distal portion having female threads therein and a distal face;

inserting a proximal end of the threaded pin connection of the first sucker rod into the proximal portion of a coupling; and rotating the sucker rod or the coupling until the pin shoulder face of the first sucker rod contacts the proximal face of the coupling; and inserting a proximal end of the threaded pin connection of the second sucker rod into the distal portion of a coupling; and rotating the second sucker rod or the coupling until the pin shoulder face of the second sucker rod contacts the proximal face of the coupling.

18. The method of claim 17, wherein adjacent wrench flats of the first sucker rod are orthogonal to each other and meet at a chamfered corner comprising a flat surface, each wrench square section has a cross sectional width ($W_S$) measured transverse to an axis (AA) of the sucker rod body and is the transverse distance across the sucker rod body between two parallel wrench flats, and wherein a relationship $W_S/D_R$ is at least 1.5; and wherein adjacent wrench flats of the second sucker rod are orthogonal to each other and meet at a chamfered corner comprising a flat surface, each wrench flat has a width ($W_S$) measured transverse to an axis (AA) of the sucker rod body and is the transverse distance across the sucker rod body between the parallel wrench flats, and wherein the relationship $W_S/D_R$ is at least 1.5.

* * * * *